US007431660B2

(12) United States Patent
Hasegawa

(10) Patent No.: US 7,431,660 B2
(45) Date of Patent: Oct. 7, 2008

(54) PUTTER-TYPE CLUB HEAD

(75) Inventor: Hiroshi Hasegawa, Kobe (JP)

(73) Assignee: SRI Sports Limited, Kobe (JP)

( * ) Notice: Subject to any disclaimer, the term of this patent is extended or adjusted under 35 U.S.C. 154(b) by 89 days.

(21) Appl. No.: 11/206,753

(22) Filed: Aug. 19, 2005

(65) Prior Publication Data

US 2006/0058113 A1 Mar. 16, 2006

(30) Foreign Application Priority Data

Sep. 10, 2004 (JP) ..... 2004-264361

(51) Int. Cl.
*A63B 69/36* (2006.01)
*A63B 53/04* (2006.01)
*A63B 53/02* (2006.01)

(52) U.S. Cl. ..... 473/251; 473/340; 473/341; 473/334; 473/349; 473/313

(58) Field of Classification Search ..... 473/219–256, 473/340–341, 313, 334, 349; D21/736–746, D21/759

See application file for complete search history.

(56) References Cited

U.S. PATENT DOCUMENTS 4,754,977 A * 7/1988 Sahm ..... 473/337
4,871,174 A * 10/1989 Kobayashi ..... 473/252
5,058,895 A 10/1991 Igarashi
5,253,869 A * 10/1993 Dingle et al. ..... 473/245
5,409,219 A * 4/1995 Saksun, Sr. ..... 473/305
5,429,356 A * 7/1995 Dingle et al. ..... 473/251
5,464,215 A * 11/1995 Koehler ..... 473/341
5,769,736 A * 6/1998 Sato ..... 473/335
5,924,938 A * 7/1999 Hines ..... 473/307
5,947,841 A * 9/1999 Silvestro ..... 473/341
5,993,324 A * 11/1999 Gammil ..... 473/251
5,997,409 A * 12/1999 Mattson ..... 473/244
6,435,976 B1 * 8/2002 Galliers ..... 473/244
6,634,956 B1 * 10/2003 Pegg ..... 473/251
6,652,390 B2 * 11/2003 Bradford ..... 473/341
6,716,110 B1 * 4/2004 Ballow ..... 473/242
6,991,555 B2 * 1/2006 Reese ..... 473/251
7,018,304 B2 * 3/2006 Bradford ..... 473/334
7,070,515 B1 * 7/2006 Liu ..... 473/340
2002/0193176 A1 * 12/2002 Grace ..... 473/341
2003/0144077 A1 * 7/2003 Cullen ..... 473/340
2003/0162599 A1 * 8/2003 Klein ..... 473/251
2006/0223649 A1 * 10/2006 Rife ..... 473/334
2007/0010348 A1 * 1/2007 Jung ..... 473/340

* cited by examiner

*Primary Examiner*—Sebastiano Passaniti
(74) *Attorney, Agent, or Firm*—Birch, Stewart, Kolasch & Birch, LLP

(57) ABSTRACT

A putter-type club head comprises a head main body with a face for hitting a ball in a front side, and a plurality of rod members firmly fixed to said head main body and extending to a rear side of the head. The rod members comprise a toe side rod member provided in a toe side, a heel side rod member provided in a heel side and an intermediate rod member provided therebetween. Each rod member has a high specific gravity larger than said head main body.

20 Claims, 7 Drawing Sheets

PUTTER-TYPE CLUB HEAD

BACKGROUND OF THE INVENTION

1. Field of the Invention

The present invention relates to a putter-type club head useful for improving a ball hitting feeling and stabilizing a directionality of the hit ball.

2. Description of the Related Art

In conventional, in order to improve the directionality of the hit ball, there have been proposed various putter-type club heads with a large moment of inertia and/or a large depth of center of gravity. In order to increase the moment of inertia, there has been known, for example, a head in which more weight is allocated in a toe and a heel side. In the head mentioned above, however, since an intermediate portion between the toe and the heel is relatively lightened, the head tends to be vibrated at a time of hitting the ball. As a result, there is a disadvantage that an impact transmitted to a hand of a player is increased, thereby deteriorating the ball hitting feeling. Further, a rolling distance of a hit ball tends to change in accordance with a hit position.

SUMMARY OF THE INVENTION

It is therefore, an object of the present invention to provide a putter-type club head which can not only stabilize a directionality and a rolling distance of a hit ball, but also improve a ball hitting feeling by reducing an impact at a time of hitting the ball.

According to one aspect of the present invention, a putter-type club head comprising a head main body having a face hitting a ball in a front side, and a plurality of rod-like members firmly fixed to said head main body and extending to a rear side of the head, said rod-like members comprising a toe side rod-like member provided in a toe side, a heel side rod-like member provided in a heel side and an intermediate rod-like member provided therebetween, and each said rod-like member having a high specific gravity larger than said head main body.

DESCRIPTION OF THE PREFERRED EMBODIMENTS

Figure 1:
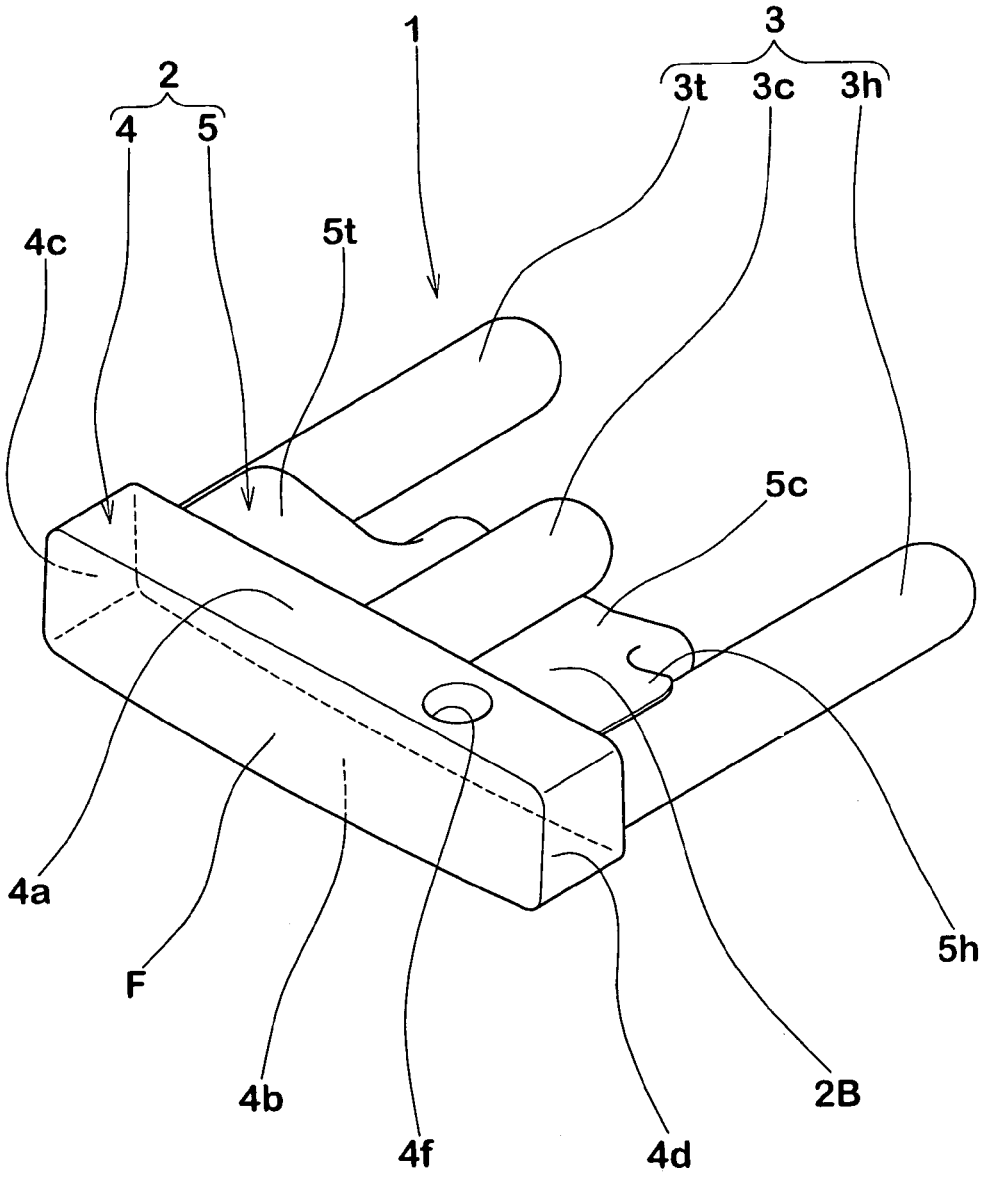
FIG. 1 is a perspective view as seen from a face side of a head, showing an embodiment of the present invention.

A description will be given below of an embodiment of the present invention with reference to the accompanying drawings.

A putter-type club head (hereinafter, refer simply to as "head") 1 of the present embodiment comprises a head main body 2 having a face F hitting a ball, and a plurality of rod-like members 3 firmly fixed to the head main body 2 and extending to a rear side of the head.

The head main body 2 integrally has a main portion 4 provided with the face F in a front surface thereof, and a sub portion 5 extending to a rear side of the head from the main portion 4 and having a smaller thickness than the main portion 4.

The main portion 4 is formed in the approximately rectangular parallelepiped shape surrounded by the face F; a top surface 4*a* extending to the rear side from an upper edge of the face F and forming an upper surface of the head; a sole surface 4*b* extending to the rear side from lower edge of the face F and forming a bottom surface of the head; a toe surface 4*c* forming a side surface close to the toe and extending to the rear side from a toe side edge of the face F; a heel surface 4*d* extending to the rear side from a heel side edge of the face F and forming a side surface close to the heel; and a rear surface 4*e* positioned in an opposite side to the face F.

In this embodiment, the top surface 4*a* is provided with a shaft insertion hole 4*f* to which a shaft SL (shown in FIG. 4) is inserted.

The rear surface 4*e* is provided with a plurality of attaching holes 6 to which the rod-like member 3 is inserted and firmly fixed.

The sub portion 5 of the present embodiment comprises a center portion 5*c* positioned in an approximately center in the toe and heel direction, a toe side portion 5*t* connected to the tow side of the center portion, and a heel side portion 5*h* connected to the heel side of the center portion 5*c*. The sub portion 5 mentioned above is useful for increasing a rigidity of the head main body 4 and positioning a center of gravity in the rear side of the head.

Further, the center portion 5*c* of the sub portion 5 has a comparatively small thickness, and extends to the rear side from a comparatively low position of the rear surface 4*e* of the main portion 4. The sole surface 4*b* of the main portion 4 is smoothly connected to a bottom surface of the center portion 5*c*.

Figure 2:
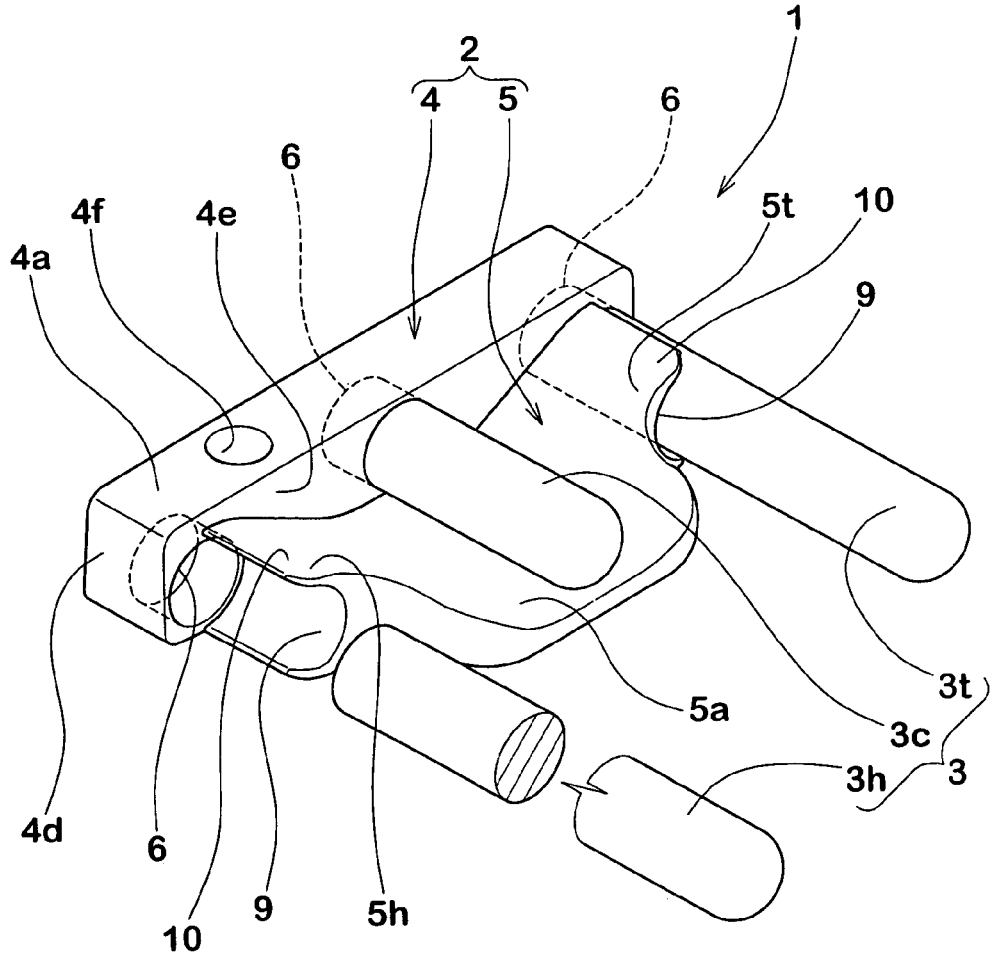
FIG. 2 is a perspective view as seen from a rear side of the head, showing the embodiment of the present invention.

Further, the toe side portion 5*t* and the heel side portion 5*h* are formed such that a length to the rear side of the head is smaller than the center portion 5*c*. The toe side portion 5*t* and the heel side portion 5*h* each has a branched portion 10 which is branched into upper and lower sides in a fork shape so as to extend by a recess portion 9 concaved along the rod-like member 3 mentioned below, as shown in FIG. 2. Accordingly, the sub portion 5 is provided without being brought into contact with the rod-like member 3. This can prevent the vibration of the rod-like member 3 from being transmitted to the sub portion 5.

The head main body 2 of the present embodiment is all structured by a metal material. As the metal material mentioned above, for example, aluminum alloy, stainless steel, maraging steel, titanium alloy, carbon steel or the like is preferable. In particularly preferable, a metal material is desirable in which a specific gravity is not more than 3.2, more preferably not more than 3.2, further preferably not more than 2.8. Accordingly, the head main body 2 can hold a sufficiently large volume while reducing a weight. On the other hand, even if the specific gravity of the material of the head main body 2 is too small, a reduction of strength and moment of inertia tends to be caused. From this point of view, it is desirable that the specific gravity mentioned above is not less than 1.0, more preferably not less than 1.2, and further preferably not less than 1.4.

Further, the head main body 2 may be structured such that a non-metal material insert such as resin, rubber or the like is used in a part of the head main body 2, for example, a part of the face F.

The rod-like member 3 is formed by a high specific gravity material in which the specific gravity is larger than the head main body 2. The rod-like member 3 includes three elements comprising a toe side rod-like member 3*t* provided in the toe side; a heel side rod-like member 3*h* provided in the heel side; and an intermediate rod-like member 3*c* provided between the rod-like members 3*t* and 3*h*.

Figure 3:
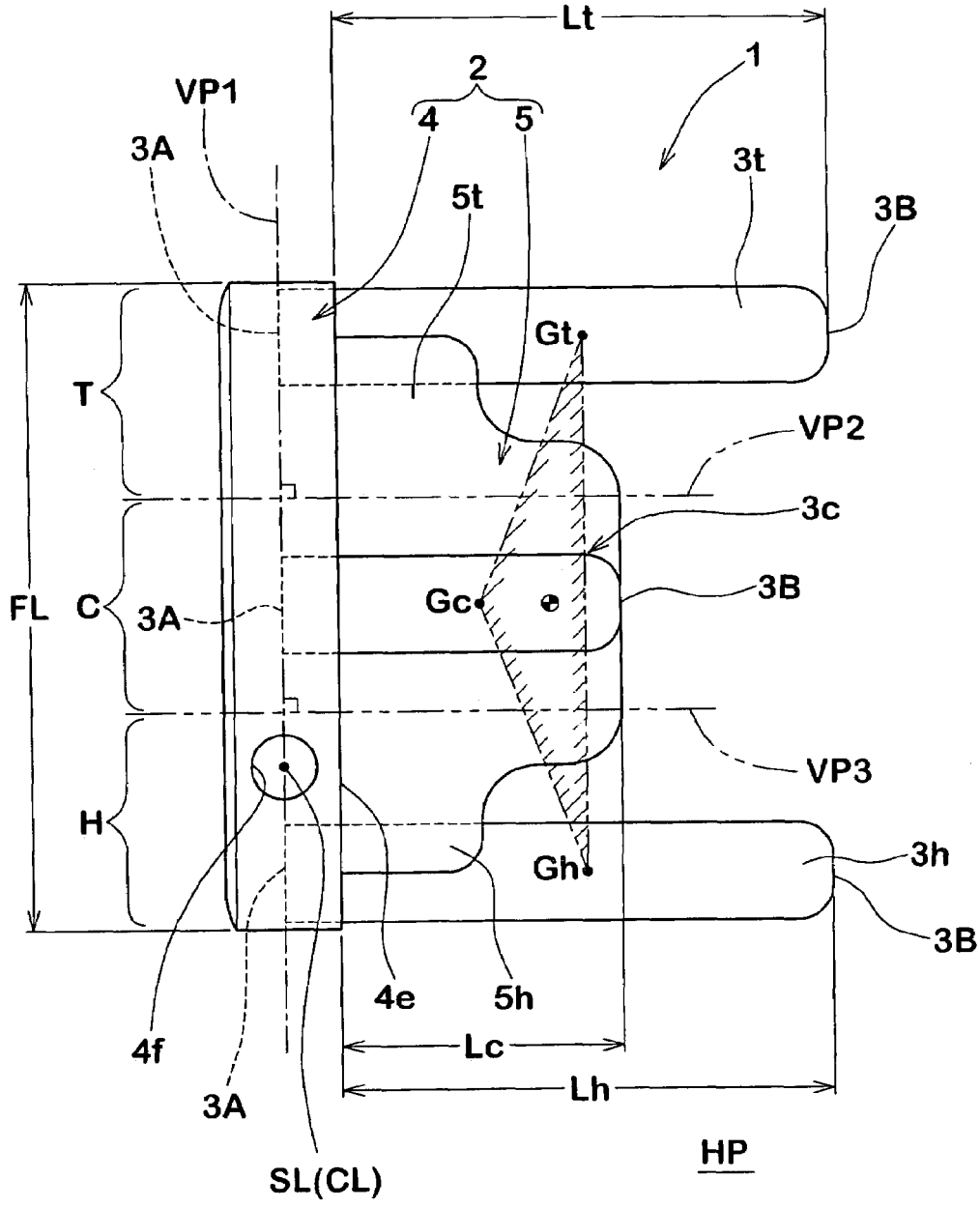
FIG. 3 is a plan view of the head.

As shown in FIG. 3, in the case that a head 1 is virtually separated into a toe side area T, a heel side area H and an intermediate area C therebetween by holding the head 1 in a standard condition and dividing a maximum length FL in the toe and heel direction of the head 1 into three equal parts, the toe side rod-like member 3*t* is provided in the toe side area T; the heel side rod-like member 3*h* is provided in the heel side area H; and the intermediate rod-like member 3*c* is provided in the intermediate area C, respectively. In the present embodiment, the intermediate rod-like member 3*c* is provided approximately at the midpoint of the toe side rod-like member 3*t* and the heel side rod-like member 3*h*.

Figure 4A:
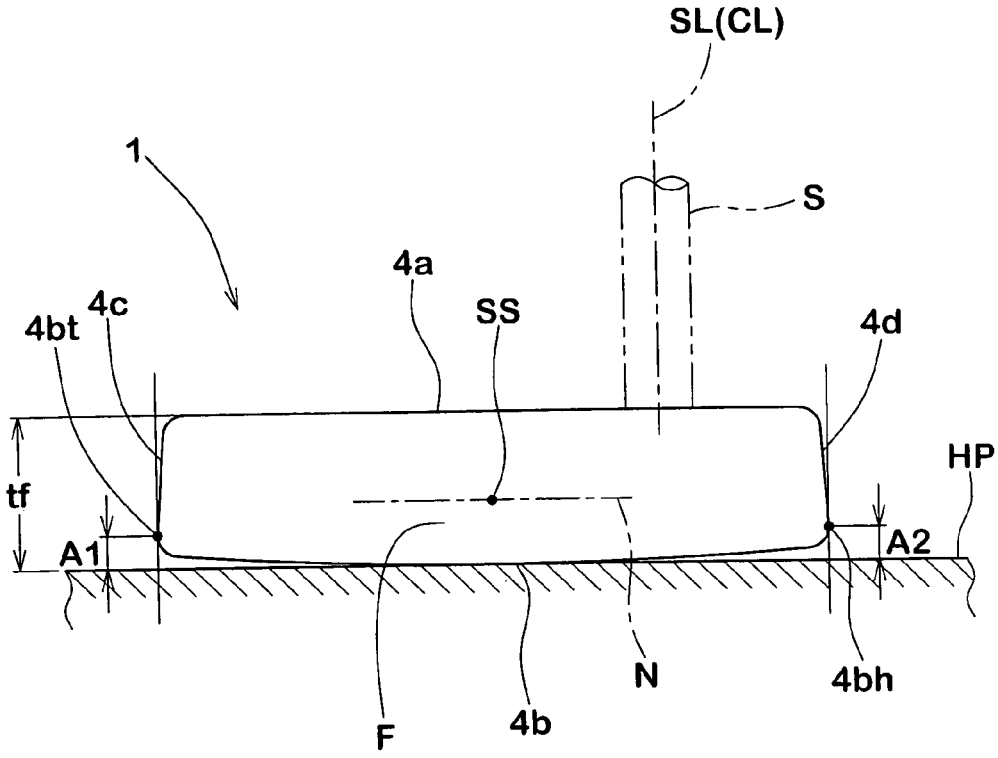
FIG. 4A is a front elevational view of FIG. 1.

In this case, the standard state mentioned above uniquely defines a position of the head 1 with respect to a horizontal surface HP, and in the present specification, it is defined as a state in which a shaft axis SL of the head 1 is arranged within an optional standard vertical surface VP1, the head 1 is grounded in such a manner that a vertical distance A1 between a toe end 4*bt* of the sole surface and the horizontal surface HP is regulated so as to be equal to a vertical distance A2 between a heel end 4*bh* of the sole surface and the horizontal surface HP, as shown in FIG. 4, and a horizontal tangent line N which is in contact with a sweet spot SS of the face F is set in parallel to the standard vertical surface VP1.

In the case that the shaft S is attached to the subject head, the shaft axis SL is set to an axial center line of the shaft S. If the shaft S is bent, the axial center line SL is defined only at a straight portion of the shaft S. The straight portion is defined in "APPENDIX II" of the rules of golf as follows:

"The shaft must be straight from the top of the grip to a point not more than 5 inches (127 mm) above the sole".

If the shaft is not attached to the head 1, a hole center line CL of the shaft insertion hole 4*f* for attaching the shaft provided in the head 1 is set as a standard. In addition, the term "three equal parts" mentioned above means that the length FL between the toe end and the heel end of the head 1 is divided into three equal parts by two vertical surfaces VP2 and VP3 which are in parallel to the standard vertical surface VP1, in a plan view (FIG. 3) in the standard state.

Since each of the rod-like members 3 is intermittently provided, a head weight is not increased too much, and it is possible to reinforce the toe side area T, the heel side area H and the intermediate area C from a side of the rear surface 4*e* of the head main body 2 in a well-balanced manner. The rod-like member 3 mentioned above can absorb and reduce the vibration of the head 1 evenly even in the case that the ball hitting point varies in the toe and heel direction, and can provide an improved ball hitting feeling and a stable ball rolling distance. Further, it is possible to make the moment of inertia and the depth of center of gravity of the head larger, by the rod-like members 3. Accordingly, a rotating motion of the head due to a miss hit of the ball is reduced, and directionality and a rolling distance of the ball become stable.

In the case that the rod-like member 3 comprises only by the toe side rod-like member 3*t* and the heel side rod-like member 3*h*, a weight of a face center portion becomes relatively small, and the portion tends to have a low rigidity. In the head mentioned above, in the case of hitting by the face center portion, the vibration is not sufficiently absorbed and reduced by the rod-like member 3, and the ball hitting feeling tends to be deteriorated. In other words, the ball hitting feeling and the ball rolling distance are largely different in accordance with the hitting position.

On the contrary, in the case that the rod-like member 3 is constituted only by the intermediate rod-like member 3*c*, the weight of the middle portion becomes relatively large in comparison with the toe side and heel side portion. Since the head mentioned above has a tendency that the moment of inertia around the center of gravity of the head becomes small, the directionality and the rolling distance of the ball are dispersed in accordance with the hitting position.

The high specific gravity material structuring the rod-like member 3 is not particularly limited as far as the specific gravity is larger than the material of the head main body 2, however, it is possible to preferably employ a tungsten, a tungsten alloy, a copper alloy, a nickel alloy or the like. In particularly preferable, it is desirable to employ a metal material in which a specific gravity is not less than 5.0, more preferably not less than 6.0 and further preferably not less than 7.0, as the high specific gravity material. Also, even if the specific gravity is too large, workability and productivity of the material tend to be lowered. Accordingly, it is desirable that the specific gravity of the high specific gravity material is preferably not more than 13.0, more preferably not more than 12.0 and further preferably not more than 11.0.

In addition, it is desirable for securing the weight enough that the rod-like member 3 is structured as a solid body.

The rod-like member 3 of the present embodiment extends in an axial direction with substantially the same cross sectional area (an area of a cross section perpendicular to the axial direction) except the chamfered portion in the rear end thereof. A leading end of each of the rod-like members 3 is inserted to the attaching hole 6 provided in the rear surface 4*e* of the head main body 2, and is firmly fixed, for example, by an adhesive agent or the like. In this embodiment, the leading end surfaces 3A of the respective rod-like members 3 are at substantially the same position in the head longitudinal direction as shown in FIG. 3. Further, the cross sectional area of each of the rod-like members 3 is substantially the same. In other words, lengths at which the respective rod-like members 3 are inserted to the head main body 2 are equal to each other.

Further, each rod-like member 3 has a cross section with a circular shape (refer to FIG. 2). The cross sectional shape of the rod-like member 3 is not particularly limited to the circular shape, but includes various shapes, for example, an oval shape, a rectangular shape, a polygonal shape and the like. However, if the cross section of the rod-like member 3 is flattened, the rod-like member itself tends to be vibrated at a time of hitting the ball, so that there is a risk that the ball hitting feeling is deteriorated. From this point of view, it is desirable that the cross section of the rod-like member 3 is structured such that an aspect ratio expressed by a ratio (Db/Da) between a maximum outer diameter Da of the rod-like member 3 and an outer diameter Db in an orthogonal direction to the maximum outer diameter is preferably not less than 0.3, more preferably not less than 0.5, further preferably not less than 0.8, particularly preferably not less than 0.9 and further preferably 1.0.

In order to sufficiently inhibit the vibration of the head 1 at a time of hitting the ball, it is desirable that the maximum outer diameter Da of the rod-like member 3 is not less than 0.25 times of a maximum height tf of the face F, and further preferably not less than 0.35 times, but not more than 1.0 times of the maximum height tf, and more preferably not more than 0.90 times.

Further, in each of the rod-like members 3 of the present embodiment, a protruding length from the rear surface 4*e* of the head main body 2 to the rear end 3B thereof satisfies the following relation:

$$0.6 \leqq Lt/Lc \leqq 4.0$$

$$0.6 \leqq Lh/Lc \leqq 4.0.$$

In this case, a reference symbol "Lt" denotes a protruding length (mm) of the toe side rod-like member 3*t*, a reference symbol "Lc" denotes a protruding length (mm) of the intermediate rod-like member 3*c*, and a reference symbol "Lh" denotes a protruding length (mm) of the heel side rod-like member 3*h*.

If the ratio (Lt/Lc) or (Lh/Lc) becomes less than 0.6, the protruding length of the rod-like member 3*t* or 3*h* in the toe side or the heel side becomes significantly smaller than the intermediate rod-like member 3*c*, so that there is a tendency that the moment of inertia of the head 1 becomes small. On the contrary, if the ratio (Lt/Lc) or (Lh/Lc) becomes more than 4.0, the protruding length of the intermediate rod-like member 3*c* becomes relatively smaller, so that dispersion tends to be generated in the vibration and the ball hitting feeling. In particularly preferable, it is desirable that the ratios (Lt/Lc) and (Lh/Lc) are more preferably not less than 1.0, and further preferably not less than 1.3, but preferably not more than 2.5, and more preferably not more than 1.8.

Mentioning by particular values, the protruding lengths Lt, Lh and LC of each of the rod-like members 3 are preferably not less than 20 mm, more preferably not less than 25 mm, and further preferably not less than 30 mm, in order to increase the moment of inertia. On the other hand, if the protruding lengths Lt, Lh and Lc of each of the rod-like members 3 are too large, the rod-like member 3 tends to be interfered with a green surface at a time of a putting swing. Accordingly, it is desirable that the protruding lengths Lt, Lh and Lc of each of the rod-like members 3 are preferably not more than 120 mm, more preferably not more than 110 mm, and further preferably not more than 100 mm.

Further, in each of the rod-like members 3 of the present embodiment, a weight of the protruding portion from the rear surface 4*e* of the head main body 2 to the rear end (accordingly, not including the weight of the portion buried in the head main body 2) satisfies the following relation:

$$0.6 \leqq Wt/Wc \leqq 4.0$$

$$0.6 \leqq Wh/Wc \leqq 4.0.$$

In this case, a reference symbol "Wt" denotes a protruding weight (g) of the toe side rod-like member 3*t*, a reference symbol "Wc" denotes a protruding weight (g) of the intermediate rod-like member 3*c*, and a reference symbol "Wh" denotes a protruding length (g) of the heel side rod-like member 3*h*.

If the ratio (Wt/Wc) or (Wh/Wc) becomes less than 0.6, the weight of the head 1 in the toe side or the heel side becomes significantly smaller than the intermediate portion, so that there is a tendency that the moment of inertia of the head 1 becomes small. On the contrary, if it becomes more than 4.0, the weight of the head intermediate portion is relatively reduced, so that dispersion tends to be generated in the vibration and the ball hitting feeling. In particularly preferable, the ratios (Wt/Wc) and (Wh/Wc) are more preferably not less than 1.0, and further preferably not less than 1.3, but preferably not more than 2.5, and more preferably not more than 1.8.

Further, the head 1 of the present embodiment is shown as an aspect that each of the protruding lengths Lt and Lh of the toe side rod-like member 3*t* and the heel side rod-like member 3*h* is larger than the protruding length Lc of the intermediate rod-like member 3*c*, and the rear ends 3B of the toe side rod-like member 3*t* and the heel side rod-like member 3*h* are positioned in the rear side from the rear end 3B of the intermediate rod-like member 3*c*. Further, in this example, the protruding lengths Lt and Lh are substantially the same.

In the head 1 mentioned above, as shown in FIG. 3, since respective center of gravities Gt, Gc and Gh of the weights Wt, Wc and Wh of the protruding portions of the respective rod-like members 3 are arranged at respective apexes of an approximately isosceles triangle protruding to the face F, a sweet spot becomes large enough, and an impact absorbing property is improved. Further, there is an advantage that a linearity of the ball is improved, and it is possible to hit the ball in a good rolling manner.

Figure 4B:
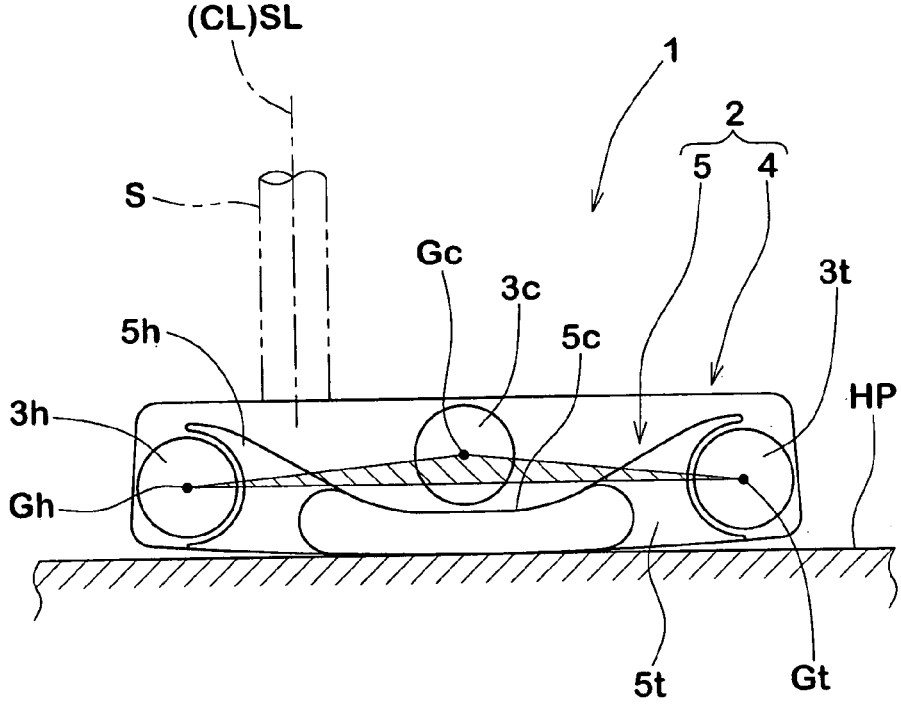
FIG. 4B is a rear elevational view of FIG. 1.
Figure 5:
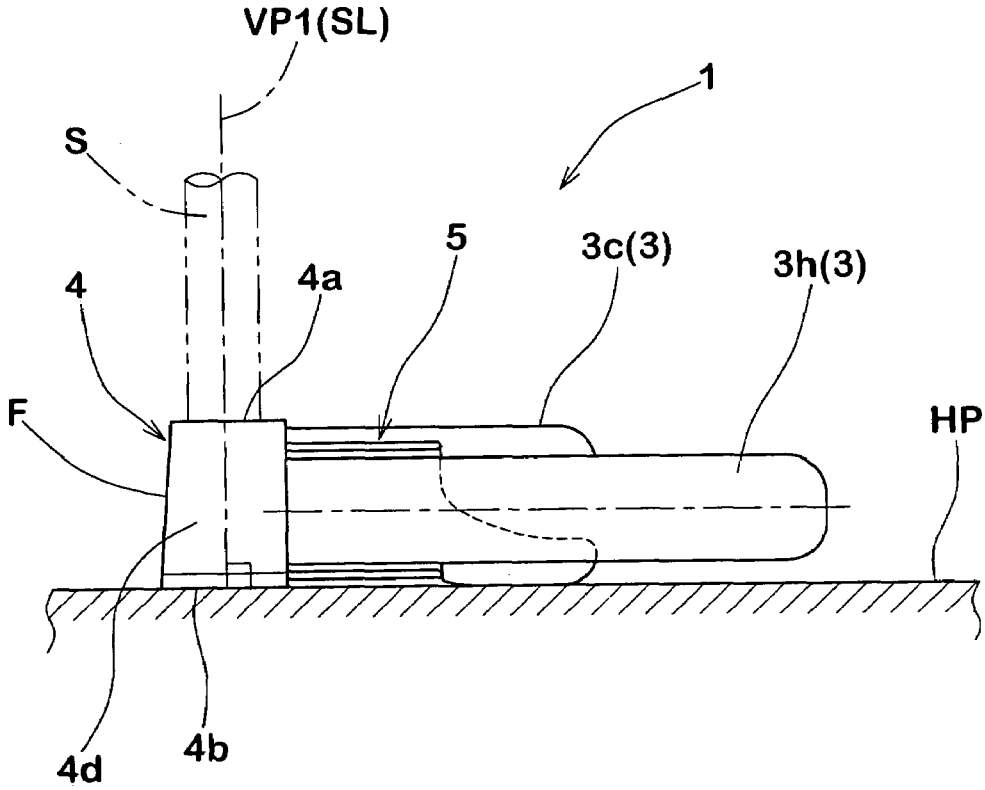
FIG. 5 is a side elevational view of FIG. 1.

In the head 1 of the present embodiment, as shown in FIGS. 4 and 5, each of the rod-like members 3 is perpendicular to the standard vertical surface VP1 and an axial centerline thereof extends in parallel to the horizontal surface HP, in the standard state. Further, as shown in FIG. 4B, the respective center of gravities Gt and Gh of the weights Wt and Wh of the protruding portions of the toe side and heel side rod-like members 3*t* and 3*h* exist in the sole side from the center of gravity Gc of the weight Wc of the protruding portion of the intermediate rod-like member 3*c*. In the head 1 mentioned above, since the respective center of gravities Gt, Gc and Gh of the weights of the protruding portions of the respective rod-like members 3 are arranged at respective apexes of an approximately isosceles triangle protruding upward, in a rear elevational view in the standard state, stability of the head is increased, and a putting stroke is smoothly performed. Further, there is an advantage that a stable ball rolling is generated.

Further, each of the rod-like members 3 is exposed to an outer portion of the head main body 2. Accordingly, golfers can use them as marks for aligning the longitudinal direction thereof in parallel to a direction of rolling the ball at a time of an address. Such a head 1 of the present embodiment is useful for accurately making the golfer to address.

An entire weight of the head 1 is not particularly limited, however, in order to increase the moment of inertia around the center of gravity of the head so as to stabilize the stroke, it is desirable that the entire weight is preferably not less than 290 g, more preferably not less than 300 g, and further preferably not less than 310 g, but preferably not more than 420 g, more preferably not more than 410 g, and further preferably not more than 400 g.

At this time, it is desirable that the weight of the intermediate area C is set equal to or more than 20% of the entire weight of the head 1, more preferably not less than 22%, and further preferably not less than 24%. If the weight of the intermediate area C is less than 20% of the entire weight of the head 1, there is a tendency that the impact force at a time of hitting the ball is hard to be reduced in the case of hitting the ball by the face F included in the intermediate area C. On the other hand, if the weight occupied by the intermediate area C becomes too large, an effect of increasing the moment of inertia of the head is reduced. From this point of view, it is desirable that the weight of the intermediate area C is equal to or less than 32% of the entire weight of the head 1, more preferably not more than 30%, and further preferably not more than 28%.

Further, in the standard state, the moment of inertia around the vertical axis passing through the center of gravity of the head 1 is preferably not less than 4000 g·cm$^2$, more preferably not less than 4800 g·cm$^2$, and further preferably not less than 5100 g·cm$^2$, in order to stabilize the directionality and the stroke of the hit ball. Also, since the entire weight of the head 1 is regulated for itself due to the reason mentioned above, it is desirable that the moment of inertia is, for example, not more than 20000 g·cm$^2$, preferably not more than 10000 g·cm$^2$, and further preferably not more than 7000 g·cm$^2$.

Figure 6:
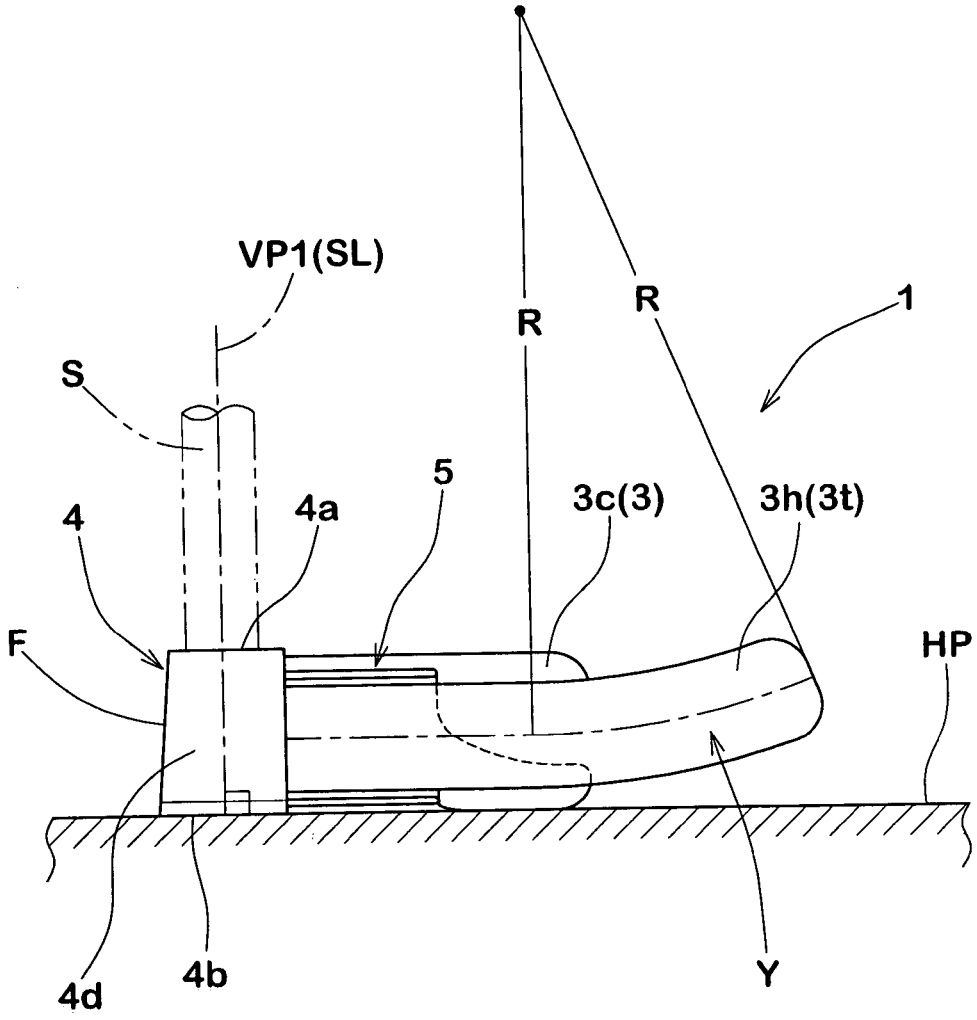
FIG. 6 is a side elevational view in a standard state, showing the other embodiment of the present invention.

FIG. 6 shows the other embodiment of the present invention. The head 1 of the embodiment comprises at least one of the rod-like members 3, in this example the toe side rod-like member 3*t* and the heel side rod-like member 3*h*, with a first curved portion Y bent to an upper side toward a rear side of the head in a side elevational view in the standard state. The first curved portion Y of the present embodiment is formed in a smooth circular arc shape with a radius R of curvature. The head hitting (putting) the ball at a time of putting is pushed out forward in accordance with a follow through. At this time, since the head tends to perform a motion similar to a circular motion around a position near a wrist of the golfer, the rod-like members 3*t* and 3*h* having the large protruding lengths tend to be interfered with the green at a time of the follow through. Since the head of the present embodiment includes the first curved portion Y curved upward of the rod-like member 3, it is possible to prevent the interference mentioned above so as to achieve a smooth putting stroke.

Figure 7:
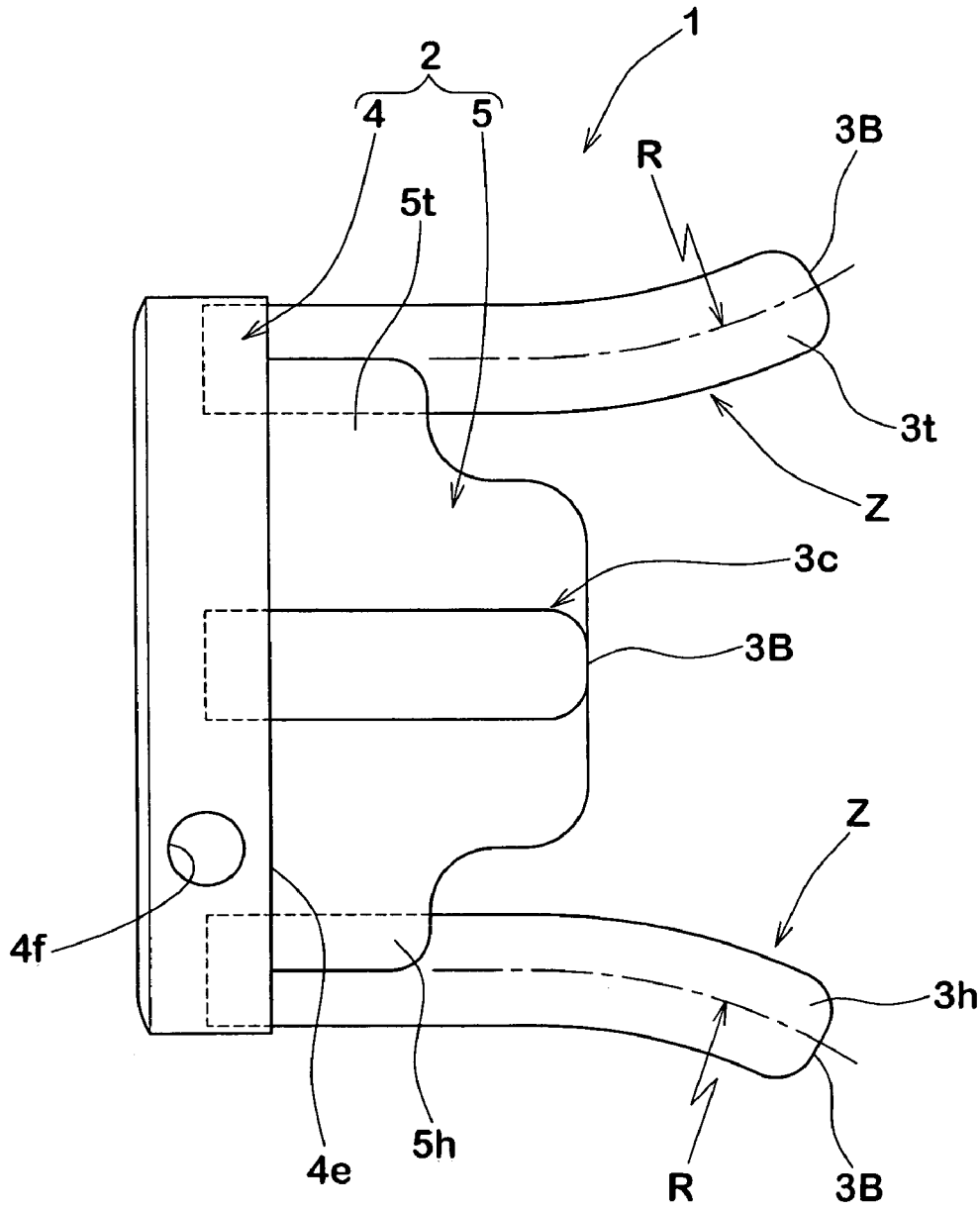
FIG. 7 is a plan view in the standard state, showing the other embodiment of the present invention.

Further, FIG. 7 shows further the other embodiment of the present invention. In this embodiment, the toe side rod-like member 3*t* and the heel side rod-like member 3*h* each comprises a second curved portion Z bent in a direction moving apart from the intermediate rod-like member 3*c* in a plan view in the standard state. The second curved portion Z of the present embodiment is formed in a smooth circular arc shape with a radius R of curvature. In the head 1 with second curved portions z mentioned above, each center of gravities of the weights of the protruding portions of the respective rod-like members 3*t* and 3*h* can be positioned apart from the intermediate rod-like member 3*c*, and it makes possible to increase the moment of inertia. Also, the rod-like member 3 may be provided with both of the second curved portion Z and the first curved portion Y.

The description is given above of the embodiments of the present invention, however, the number of the rod-like member 3 is not limited to three, but one rod-like member may be provided at least in each of the areas. Further, it goes without saying that the shape of the head main body can be variously modified.

Comparison Test

In order to check out the effect of the present invention, plural kinds of putter-type club heads were manufactured by way of trial on the basis of the specification in Table 1, and an actual hitting test was executed with respect to each of them. All of the heads employed aluminum alloy with specific gravity of 2.7 for the head main body, and stainless steel with a specific gravity of 7.8 for the rod-like member, respectively. Further, the actual hitting test was executed by putting ten golf balls ("HI-BRID Everrio" manufactured by SRI sports Limited) aiming at a cup arranged at 5 m forward by using each of the trial clubs by ten golfers (having handicaps between 15 and 25). Particular test contents and standard of evaluation are as follows.

Impact Property;

An impact felt by hands was marked on the basis of the ten ball putting result. The evaluation was obtained by an average score of the marked values by the respective golfers. The larger the numerical value is, the better the property is.

5: impact is extremely small
4: impact is small
3: average
2: impact is large
1: impact is extremely large Dispersion of Impact Property;

The ten ball putting was executed while intentionally shifting the hitting point position in the toe and heel direction, and the dispersion of the impact felt by the hands was marked on the basis of the result. The evaluation was obtained by an average score of the marked values by the respective golfers. The larger the numerical value is, the better the property is.

5: dispersion of impact is extremely small
4: dispersion of impact is small
3: average
2: dispersion of impact is large
1: dispersion of impact is extremely large Dispersion of Rolling Distance of Hit Ball;

The rolling distances of ten balls putted toward the target cup were respectively measured, and the maximum dispersion of the distance obtained by subtracting the minimum rolling distance from the maximum rolling distance was measured. The evaluation was obtained by an average score of the marked values by the respective golfers. The smaller the numerical value is, the better the property is.

Directionality of Hit Ball;

The maximum shift amount in a leftward direction and a rightward direction perpendicular to the target line was measured with respect to the hit ten balls, and the maximum shift amount corresponding to a sum of both the amounts was determined. The evaluation was obtained by an average score of the marked values by the respective golfers. The smaller the numerical value is, the better the property is. The results of the tests and the like are shown in Table 1.

TABLE 1

| | | Ref. 1 | Ex. 1 | Ex. 2 | Ex. 3 | Ex. 4 | Ex. 5 | Ex. 6 | Ref. 2 |
|---|---|---|---|---|---|---|---|---|---|
| Specification of rod-like member | Protruding length Lt (mm) | 90.0 | 80.0 | 75.0 | 70.0 | 65.0 | 60.0 | 50.0 | 0.0 |
| | Protruding length Lc (mm) | 0.0 | 20.0 | 30.0 | 40.0 | 50.0 | 60.0 | 80.0 | 90.0 |
| | Protruding length Lh (mm) | 90.0 | 80.0 | 75.0 | 70.0 | 65.0 | 60.0 | 50.0 | 0.0 |
| | Ratio (Lt/Lc) | — | 4.0 | 2.5 | 1.8 | 1.3 | 1.0 | 0.6 | 0.0 |
| | Ratio (Lh/Lc) | — | 4.0 | 2.5 | 1.8 | 1.3 | 1.0 | 0.6 | 0.0 |
| | Weight Wt (g) | 108.1 | 96.1 | 90.1 | 84.1 | 78.0 | 72.0 | 60.0 | 0.0 |
| | Weight Wc (g) | 0.0 | 24.0 | 36.0 | 48.0 | 60.0 | 72.0 | 96.1 | 220.5 |
| | Weight Wh (g) | 108.1 | 96.1 | 90.1 | 84.1 | 78.0 | 72.0 | 60.0 | 0.0 |
| | Entire weight of protruding portion (Wt + Wc + Wh) (g) | 216.2 | 216.2 | 216.2 | 216.2 | 216.0 | 216.0 | 216.1 | 220.5 |

TABLE 1-continued

| | | Ref. 1 | Ex. 1 | Ex. 2 | Ex. 3 | Ex. 4 | Ex. 5 | Ex. 6 | Ref. 2 |
|---|---|---|---|---|---|---|---|---|---|
| | Ratio (Wt/Wc) | — | 4.0 | 2.5 | 1.8 | 1.3 | 1.0 | 0.6 | 0.0 |
| | Ratio (Wh/Wc) | — | 4.0 | 2.5 | 1.8 | 1.3 | 1.0 | 0.6 | 0.0 |
| | Maximum outer diameter (mm) of toe side rod-like member | 14.0 | 14.0 | 14.0 | 14.0 | 14.0 | 14.0 | 14.0 | 0 |
| | Maximum outer diameter (mm) of intermediate rod-like member | 0 | 14.0 | 14.0 | 14.0 | 14.0 | 14.0 | 14.0 | 10.0 |
| | Maximum outer diameter (mm) of heel side rod-like member | 14.0 | 14.0 | 14.0 | 14.0 | 14.0 | 14.0 | 14.0 | 0 |
| Moment of inertia around vertical axis passing through center of gravity of head | | 5350 | 6000 | 5650 | 5400 | 5150 | 5100 | 4850 | 3900 |
| Test results | Impact property (A) | 3 | 4 | 4 | 4 | 4 | 4 | 4 | 3 |
| | Dispersion of impact property (B) | 2 | 3 | 4 | 5 | 5 | 4 | 4 | 1 |
| | Dispersion of rolling distance (C) | 3 | 2 | 2 | 1 | 1 | 1 | 2 | 4 |
| | Directionality (D) | 1 | 1 | 1 | 1 | 1 | 2 | 3 | 3 |
| | Total evaluation (A) + (B) − (C) − (D) | 1 | 4 | 5 | 7 | 7 | 5 | 3 | −3 |

As a result of the tests, it was confirmed that the head of the example had an improved ball hitting feeling and was able to obtain a stable rolling distance. As a total evaluation, a satisfactory result was obtained. As mentioned above, in the putter-type club head of the example, it is possible to make the moment of inertia and the depth of center of gravity in the head large enough, without the rod-like member increasing the head weight excessively. Further, since the rod-like member is provided in the toe side, the heel side and the portion therebetween in a dispersed manner, it is possible to uniformly reinforce the face. Accordingly, it is possible to prevent the directionality and the rolling distance from being dispersed due to the dispersion of the hitting point. Further, it is possible to evenly absorb and reduce the impact of the head regardless of the position of the hitting point, whereby it is possible to provide an improved ball hitting feeling.

The invention claimed is:

1. A putter-type club head comprising a head main body having a front surface defining a face for hitting a ball and a rear surface opposite the front surface, and a plurality of rod members firmly fixed to said head main body and extending beyond the rear surface of the head main body, said rod members comprising a toe side rod member provided in a toe side of the head main body, a heel side rod member provided in a heel side of the head main body and an intermediate rod member provided therebetween, and each said rod member having a high specific gravity larger than said head main body, wherein a part of each rod member extends perpendicularly to a horizontal tangent line which is in contact with a sweet spot of the face in a plan view of the club head, each rod member is provided without contacting each other, and wherein a protruding length Lt (mm) from the rear surface of the head main body to a rear end of the toe side rod member, a protruding length Lc (mm) from the rear surface of the head main body to a rear end of the intermediate rod member and a protruding length Lh (mm) from the rear surface of the head main body to a rear end of the heel side rod member satisfy the following relation:

$$1.0 \leqq Lt/Lc \leqq 4.0$$

$$1.0 \leqq Lh/Lc \leqq 4.0.$$

2. The putter-type club head according to claim 1, wherein the protruding length Lt (mm), the protruding length Lc (mm) and the protruding length Lh (mm) satisfy the following relation:

$$1.3 \leqq Lt/Lc \leqq 2.5$$

$$1.3 \leqq Lh/Lc \leqq 2.5.$$

3. The putter-type club head according to claim 1, wherein the protruding length Lt (mm), the protruding length Lc (mm) and the protruding length Lh (mm) satisfy the following relation:

$$1.3 \leqq Lt/Lc \leqq 4.0$$

$$1.3 \leqq Lh/Lc \leqq 4.0.$$

4. The putter-type club head according to claim 2 or 3, wherein cross sectional areas of the respective rod members are substantially the same.

5. The putter-type club head according to claim 1, wherein the protruding length Lt (mm) and the protruding length Lh (mm) are substantially the same.

6. The putter-type club head according to claim 1, wherein a weight Wt(g) of a protruding portion of the toe side rod member which extends beyond the rear surface of the head main body, a weight Wc(g) of a protruding portion of the intermediate rod member which extends beyond the rear surface of the head main body and a weight Wh(g) of a protruding portion of the heel side rod member which extends beyond the rear surface of the head main body satisfy the following relation:

$0.6 \leqq Wt/Wc \leqq 4.0$ $0.6 \leqq Wh/Wc \leqq 4.0$.

7. The putter-type club bead according to claim 1, wherein a weight Wt(g) of a protruding portion of the toe side rod member which extends beyond the rear surface of the head main body, a weight Wc(g) of a protruding portion of the intermediate rod member which extends beyond the rear surface of the head main body and a weight Wh(g) of a protruding portion of the heel side rod member which extends beyond the rear surface of the head main body satisfy the following relation:

$1.3 \leqq Wt/Wc \leqq 4.0$ $1.3 \leqq Wh/Wc \leqq 4.0$.

8. The putter-type club head according to claim 1, wherein respective protruding lengths of the toe side rod member and the heel side rod member are longer than the protruding length of said intermediate rod member, and the rear ends of said toe side rod member and the heel side rod member are located beyond the rear end of said intermediate rod member toward the rear side of the head.

9. The putter-type club head according to claim 1, wherein respective centers of gravity of protruding portions of the toe side rod member and the heel side rod member which extend beyond the rear surface of the head main body are located beyond a center of gravity of a protruding portion of said intermediate rod member which extends beyond the rear surface of the head main body toward the rear side of the head.

10. The putter-type club head according to claim 1, wherein respective centers of gravity of protruding portions of the toe side rod member and the heel side rod member which extend beyond the rear surface of the head main body are located lower than a center of gravity of a protruding portion of said intermediate rod member which extends beyond the rear surface of the head main body.

11. The putter-type club head according to claim 1, wherein each toe side and heel side rod member has a first curved portion which is curved to an upper side toward the rear side of the head.

12. The putter-type club head according to claim 1, wherein the toe side rod member and/or the heel side rod member has a second curved portion which is curved in a direction moving apart from the intermediate rod member toward the rear side of the head.

13. The putter-type club head according to claim 1, wherein the head has a weight in a range of from 290 g to 420 g.

14. The putter-type club head according to claim 1, wherein the toe side rod member and the heel side rod member have substantially the same cross sectional area, and each toe side and heel side rod member has a first curved portion which is curved to an upper side toward the rear side of the head.

15. The putter-type club head according to claim 1, wherein the head main body comprises a main portion formed in the approximately rectangular parallelepiped shape and provided with the face and a sub portion extending to the rear side of the head from the rear surface of the main portion and having a smaller thickness than that of the main portion, the rear surface of the main portion is provided with a plurality of attaching holes to which said rod members are fixed, and the sub portion is provided without contacting said rod members.

16. The putter-type club head according to claim 15, wherein the sub portion of the head main body comprises a center portion positioned in an approximately center in the toe and heel side of the head main body, a toe side portion connected to the toe side of the center portion and a heel side portion connected to the heel side of the center portion, the center portion extends to the rear side of the head from the rear surface of the main portion under the intermediate rod member, and the toe side portion and the heel side portion each has a branched portion having a recess concave along rod members.

17. A putter-type club head comprising a head main body having a front surface defining a face for hitting a ball, and a plurality of rod members firmly fixed to said head main body and extending to a rear side of the head, said rod members comprising a toe side rod member provided in a toe side of the head main body, a heel side rod member provided in a heel side of the head main body and an intermediate rod member provided therebetween, each said rod member having a high specific gravity larger than that of said head main body, wherein respective centers of gravity of protruding portions of the toe side rod member and the heel side rod member are located lower than a center of gravity of a protruding portion of said intermediate rod member.

18. A putter-type club head comprising a head main body having a front surface defining a face for hitting a ball, and a plurality of rod members firmly fixed to said head main body and extending to a rear side of the head, said rod members comprising a toe side rod member provided in a toe side of the head main body, a heel side rod member provided in a heel side of the head main body and an intermediate rod member provided therebetween, each said rod member having a high specific gravity larger than that of said head main body, wherein a part of each rod member extends perpendicularly to a horizontal tangent line which is in contact with a sweet spot of the face in a plan view of the club head, each rod member is provided without contacting each other, respective protruding lengths of the toe side rod member and the heel side rod member are longer than a protruding length of said intermediate rod member, and the rear ends of said toe side rod member and the heel side rod member are located beyond the rear end of said intermediate rod member toward the rear side of the head.

19. A putter-type club head comprising a head main body having a front surface defining a face for hitting a ball, and a plurality of rod members firmly fixed to said head main body and extending to a rear side of the head, said rod members comprising a toe side rod member provided in a toe side of the head main body, a heel side rod member provided in a heel side of the head main body and an intermediate rod member provided therebetween, each said rod member having a high specific gravity larger than that of said head main body, wherein a part of each rod member extends perpendicularly to a horizontal tangent line which is in contact with a sweet spot of the face in a plan view of the club head, each rod member is provided without contacting each other, and respective centers of gravity of protruding portions of the toe side rod member and the heel side rod member are located beyond a center of gravity of a protruding portion of said intermediate rod member toward the rear side of the head.

20. A putter-type club head comprising a head main body having a front surface defining a face for hitting a ball, and a plurality of rod members firmly fixed to said head main body and extending to a rear side of the head, said rod members comprising a toe side rod member provided in a toe side of the head main body, a heel side rod member provided in a heel side of the head main body and an intermediate rod member provided therebetween, each said rod member having a high specific gravity larger than that of said head main body, wherein a part of each rod member extends perpendicularly to a horizontal tangent line which is in contact with a sweet spot of the face in a plan view of the club head, each rod member is provided without contacting each other, and respective centers of gravity of protruding portions of the toe side rod member and the heel side rod member are located lower than a center of gravity of a protruding portion of said intermediate rod member.

* * * * *